United States Patent [19]

Lang

[11] 4,075,079

[45] Feb. 21, 1978

[54] PROCESS FOR THE PRODUCTION OF HYDROCARBONS FROM COAL

[75] Inventor: Robert J. Lang, Baytown, Tex.

[73] Assignee: Exxon Research & Engineering Co., Linden, N.J.

[21] Appl. No.: 694,410

[22] Filed: June 9, 1976

[51] Int. Cl.[2] ..... C10G 1/04; C10B 57/04

[52] U.S. Cl. ..... 208/8; 208/127; 201/20; 48/197 R; 48/210; 252/373

[58] Field of Search ..... 208/8, 10, 127; 48/210, 48/197 R, 214; 201/21, 22, 24, 20, 6, 8

[56] References Cited

U.S. PATENT DOCUMENTS 3,841,991 10/1974 Cohen et al. ..... 208/8

*Primary Examiner*—Delbert E. Gantz
*Assistant Examiner*—James W. Hellwege
*Attorney, Agent, or Firm*—James E. Reed

[57] ABSTRACT

Coal is liquefied by treatment with a hydrogen-donor solvent and gaseous hydrogen, a heavy bottoms product boiling primarily in excess of about 1000° F. is recovered, and this bottoms product is then pyrolyzed with fresh coal to produce surprisingly high yields of liquid product. The coke formed during the pyrolysis step may be gasified to generate hydrogen for use in the liquefaction operation and additional gas which can be employed as a fuel or upgraded for other uses.

11 Claims, 3 Drawing Figures

PROCESS FOR THE PRODUCTION OF HYDROCARBONS FROM COAL

BACKGROUND OF THE INVENTION

1. Field of the Invention

This invention relates to the production of hydrocarbons from coal and is particularly concerned with coal liquefaction operations in which the liquefaction bottoms are pyrolyzed to produce additional products.

2. Description of the Prior Art

There have been numerous processes developed for the production of liquid hydrocarbons from coal and similar carbonaceous solids. Among the most promising of these are processes in which the feed coal is first contacted with a hydrogen-containing gas and a hydrogen-donor solvent at elevated temperature and pressure in a liquefaction reactor and a portion of the liquid product is then catalytically hydrogenated in a solvent hydrogenation reactor to generate additional liquid products and solvent for recycle to the liquefaction step. If the liquefaction and solvent hydrogenation steps are carried out under similar pressure conditions, the vaporous products formed during liquefaction may be passed directly to the solvent hydrogenation reactor. Otherwise, these products will generally be treated for the removal of contaminants, compressed and heated, and then introduced into the solvent hydrogenation vessel. The liquid effluent from the liquefaction step is normally passed to a low pressure separator in which gases are taken off and then fractionated, the lighter constituents being employed as feed to the solvent hydrogenation reactor and the heavier material which for the most part boils above about 1000° F. and contains ash and unreacted coil solids being recovered for upgrading into lower boiling products. Alternatively, the liquid stream obtained following the removal of gases from the liquefaction reactor liquid effluent can be mixed with a hydrocarbon liquid or antisolvent and then treated for the removal of solids by settling, filtration or centrifugation. The liquid overhead fraction recovered from this solids removal step can then be fractionated to produce liquids suitable for use in the hydrogenation step and a heavy bottoms fraction which can be further treated to produce lighter, lower boiling products. The liquid products obtained from the solvent hydrogenation step of the process are fractionated, the lighter constituents being taken overhead for use as fuel or the like and the heavier constituents being recycled for use as solvent in the liquefaction step or recovered as additional product.

One disadvantage of processes of the type described above and other coal liquefaction systems is that the amount of heavy bottoms produced during liquefaction is generally high and may constitute as much as half of the total yield from the liquefaction step. There have been numerous proposals for converting these heavy bottoms into lighter products of higher value, including suggestions that they be used as feed for hydrogenation, catalytic cracking, or pyrolysis operations. The bottoms are normally difficult to hydrogenate and are generally poor candidates for catalytic cracking because contaminants present may damage the cracking catalyst. Pyrolysis in a batch or continuous coking unit is therefore considered the most promising method for upgrading liquefaction bottoms. This results in the production of additional liquids and gases and in the formation of coke which can be subsequently gasified to produce hydrogen useful in the liquefaction operation. The gas and liquid yields from the pyrolysis step tend to be low and the amount of coke produced tends to be high. Efforts to improve the yields by reducing coke formation during pyrolysis have met with only limited success.

SUMMARY OF THE INVENTION

This invention provides an improved, integrated process which alleviates the difficulties outlined above. In accordance with the invention, it has now been found that the pyrolysis of a mixture of heavy liquefaction bottoms and fresh coal or similar carbonaceous solids containing volatilizable hydrocarbons results in a higher yield of liquid products and in a lower yield of coke than would normally be expected on the basis of the yields obtained from the liquefaction bottoms and coal individually. The reasons for this increased yield of liquids and lower yield of coke are not fully understood but tests indicate that molecular fragments which are formed during the pyrolysis step and would normally polymerize to form coke are in some way stabilized as liquids by molecular fragments which would otherwise emerge as gas. The result is a significant increase in the total quantity of liquid products recovered. In some cases an increase in liquid yield of 10% or more is obtained. In a large integrated plant for the production of coal liquids, this may permit the recovery of several thousand additional barrels of liquid product per day. The process could therefore have a significant impact on the economics of producing liquid hydrocarbons from coal.

In a preferred embodiment of the invention, feed coal is first contacted with a hydrogen-donor solvent and gaseous hydrogen in a coal liquefaction zone and a heavy bottoms fraction boiling primarily in excess of about 1000° F. by microlube distillation is recovered. This bottoms fraction and fresh feed coal are then fed to a fluidized bed or other coking unit in a bottoms-to-coal ratio of from about 1:10 to about 10:1, preferably from about 0.3:1 to about 3:1, to produce gases, additional liquids, and coke particles. The coke particles, alone or in combination with more fresh coal, are fed to a fluidized bed gasifier in which the carbonaceous solids are gasified for the production of hydrogen which is ultimately recycled to the liquefaction step. At least part of the char fines produced during gasification may be recycled to the coking step of the process. This embodiment of the invention has particular advantages in that it provides a means for producing substantially greater yields of valuable intermediate boiling range liquid products than are normally obtained in coal conversion processes, results in better carbon conversion and greater overall process efficiency than might otherwise be obtained, reduces the quantity of solids produced as a by-product of the operation, and has other benefits. As a result, the process has widespread potential application.

DESCRIPTION OF THE PREFERRED EMBODIMENTS

Figure 1:
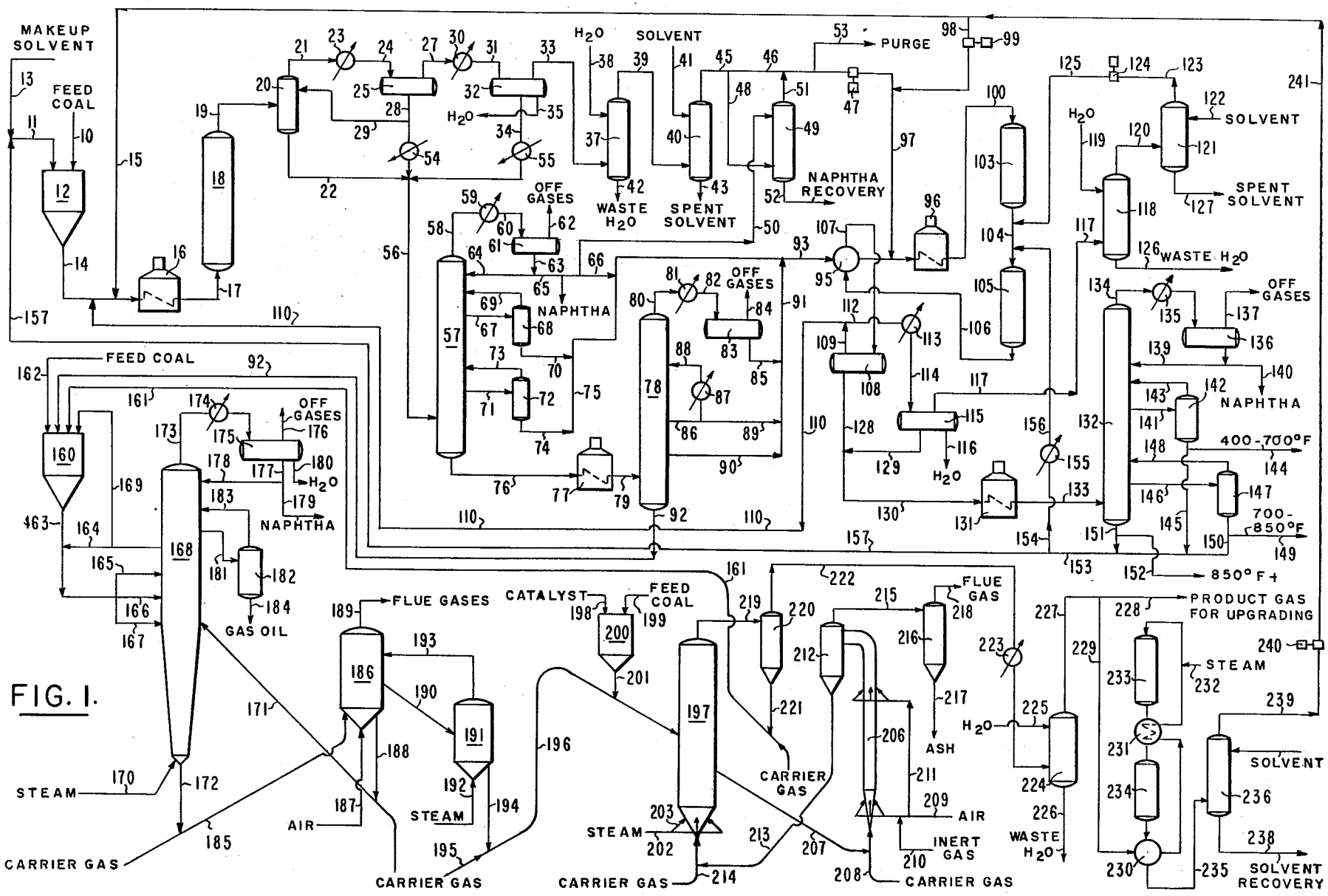
FIG. 1 in the drawing is a schematic flow diagram of an integrated process for the conversion of coal or similar carbonaceous solids containing volatilizable hydrocarbons carried out in accordance with the invention.

The process depicted in the drawing is an integrated process for the production of liquids and gaseous products from bituminous coal, subbituminous coal, lignite, or the like in which the solid feed material is liquefied to produce liquid products and a heavy bottoms fraction boiling in excess of about 1000° F., this bottom fraction is blended with fresh coal and with char fines from a fluidized bed gasifier associated with the unit, the blended material is subsequently coked in a fluidized bed coking unit to form additional liquids, gaseous products and solid coke particles, and these coke particles are then gasified in the fluidized bed gasifier to form hydrogen for use in the liquefaction step of the process and gaseous products useful for other purposes. It will be understood that the process is not restricted to the particular type of liquefaction, gasification and coking units shown in the drawing and that other systems operating in similar fashion can also be used.

In the process shown in FIG. 1 of the drawing, feed coal is introduced into the system through line 10 from a coal storage or feed preparation zone not shown in the drawing and combined with a hydrogen-donor solvent introduced through line 11 to form a slurry in slurry preparation zone 12. The feed coal employed will normally consist of solid particles of bituminous coal, subbituminous coal, lignite, or a mixture of two or more such materials having a particle size on the order of about one-fourth inch or smaller along the major dimensions. It is generally preferred to employ coal which has been crushed and screened to a particle size of about 8 mesh or smaller on the U.S. Sieve Series scale. The feed coal may be dried to remove excess water, either by conventional techniques before the solids are mixed with the solvent in the slurry preparation zone or by mixing the wet solids with hot solvent at a temperature above the boiling point of water, preferably between about 250° F. and about 350° F., to vaporize the water in the preparation zone. The moisture in the feed slurry will preferably be reduced to less than about 2 weight percent.

The hydrogen-donor solvent used in preparing the coal-solvent slurry will normally be a coal derived solvent, preferably a hydrogenated recycle solvent containing at least 20 weight percent of compounds which are recognized as hydrogen donors at elevated temperature of from about 700° to about 900° F. or higher. Solvents containing at least 50 weight percent of such compounds ae preferred. Representative compounds of this type include indane, $C_{10}$–$C_{12}$ tetrahydronaphthalenes, $C_{12}$ and $C_{13}$ acenaphthenes, di-, tetra- and octahydroanthracenes, tetrahydroacenaphthenes, crysene, phenanthrene, pyrene, and other derivatives of partially saturated aromatic compounds. Such solvents have been described in the literature and will be familiar to those skilled in the art. The solvent composition resulting from the hydrogenation of recycle solvent fractions will depend in part upon the particular coal used as the feedstock to the process, the process steps and operating conditions employed, and the conditions used in hydrogenating the solvent fractions selected for recycle following liquefaction. In the slurry preparation zone 12, the incoming feed coal is normally mixed with solvent in a solvent-to-coal ratio of from about 0.8:1 to about 2:1. The solvent employed on the initial startup of the process and any makeup solvent required can be added to the system through line 13.

The coal-solvent slurry prepared as described above is withdrawn from slurry preparation zone 12, passed through line 14 where it is mixed with vapor recycled through line 15, and introduced into mixed phase preheat furnace 16 where the feed materials are heated to a temperature within the range between about 750° F. and about 950° F. Alternatively, the vapor can be preheated in a separate furnace not shown in the drawing and thereafter mixed with the hot effluent from furnace 16. The hot fluid withdrawn from the furnace through line 17 will normally contain from about 1 to about 8 weight percent, preferably from about 2 to about 5 weight percent, of hydrogen on a moisture and ash-free coal basis. This hot feed stream is then introduced into liquefaction reactor 18 which is maintained at a temperature between about 750° F. and about 950° F. and at a pressure between about 1000 psig and about 3000 psig, preferably between about 1500 and about 2500 psig. Although a single liquefaction reactor is shown in the drawing, a plurality of upflow or other type reactors arranged in parallel or series can also be employed. The liquid residence time within reactor 18 will normally range between about 5 minutes and 100 minutes, preferably between about 10 and about 60 minutes.

Within liquefaction zone 18, high molecular weight constituents of the feed coal are broken down and hydrogenated to form lower molecular weight gaseous, vapor and liquid products. The hydrogen-donor solvent contributes hydrogen atoms which react with organic radicals liberated from the coal and prevent their recombination. The hydrogen in the recycle vapor stream injected with the slurry serves as replacement hydrogen for depleted hydrogen-donor molecules in the solvent and results in the formation of additional hydrogen-donor molecules by in situ hydrogenation. The process conditions within the liquefaction zone are selected to insure the generation of sufficient hydrogen-donor precursors and at the same time provide sufficient liquid product for proper operation of the solvent hydrogenation zone. These conditions may be varied as necessary.

A liquefaction reactor product stream including gaseous products such as carbon monoxide, carbon dioxide, ammonia, hydrogen, hydrogen sulfide, methane, ethane, ethylene, propane, propylene and the like, unreacted hydrogen from the feed slurry, solvent, and heavier liquefaction products is taken off overhead from the liquefaction reactor through line 19. This stream is passed to reactor effluent separator 20 where it is separated at substantially liquefaction reactor pressure and at a temperature only slightly lower than that in the liquefaction reactor into an overhead vapor stream which is withdrawn through line 21 and a liquid stream taken off through line 22. The vapor stream may be passed through heat exchanger 23 and cooled to a temperature between about 400° and about 700° F. and then introduced through line 24 into hot liquefaction separator 25, still at substantially liquefaction pressure.

The vapor stream introduced into separator 25 is separated into a stream of gases and vapors which are withdrawn through line 27 and a liquid stream taken off through line 28. A portion of this liquid stream may be recycled through line 29 to reactor effluent separator 20 if desired. The gases and vapors in line 27 pass through heat exchanger 30 where they are further cooled, preferably to substantially atmospheric temperature, without any substantial reduction in pressure. From the heat exchanger, the cooled gases and vapors flow through line 31 into cold liquefaction separator 32 where further separation takes place. An overhead stream containing hydrogen, carbon monoxide, carbon dioxide, ammonia, hydrogen sulfide, hydrogen chloride, normally gaseous hydrocarbons and some naphtha boiling range hydrocarbons is withdrawn through line 33. A liquid stream containing dissolved gases but composed primarily of liquid hydrocarbons boiling below about 700° F. at atmospheric pressure is recovered through line 34. A sour water stream produced by the condensation of water vapor is withdrawn through line 35.

The gases and vapors recovered from the cold liquefaction separator are passed through line 33 into liquefaction water scrubber 37 where they are contacted with water added through line 38 for the removal of ammonia, hydrogen chloride, and other water-soluble constituents. The scrubber may be a conventional spray-type unit, a venturi scrubber or the like. The scrubber gas and vapor is then passed through line 39 to solvent scrubber 40 where it is contacted with monoethanolamine, diethanolamine, or a similar absorbent introduced through line 41 for the removal of hydrogen sulfide, carbon dioxide and other acid gases. The spent scrubber water is withdrawn from scrubber 37 through line 42. The spent solvent withdrawn from the solvent scrubber through line 43 is thereafter passed to a solvent recovery unit not shown in the drawing for the removal and recovery of the adsorbed materials and regeneration of the solvent. The regeneration step is generally carried out by flashing and steam stripping but the particular method employed will depend upon the solvent selected, the contaminants present in the spent solvent stream, and other factors.

The gases and accompanying vapors from which ammonia and acid gases have been removed are taken overhead from the solvent scrubber through line 45. This stream may be passed by way of line 46 to solvent hydrogenation feed compressor 47. Alternatively, the gases and vapors may be directed through line 48 to naphtha scrubber 49 where they are contacted with naphtha introduced through line 50 for the removal of carbon monoxide, methane and higher hydrocarbons. This naphtha scrubbing step normally results in a treated gas stream of higher purity and reduces the purge requirements of the system. The treated gas is then passed through line 51 and the spent naphtha is withdrawn through line 52 for recovery. The gas or mixture of gas and vapors fed to the solvent hydrogenation compressor will normally include carbon monoxide and light hydrocarbon gases not removed in the scrubbers. A portion of this gas or mixture will normally be purged through line 53 to prevent the buildup of these materials within the system.

The liquid stream withdrawn from reactant effluent separator 20 through line 22 is passed through a pressure letdown valve not shown in the drawing to reduce the pressure to about 100 psia or less. The liquids withdrawn from hot liquefaction separator 25 through line 28 and from cold liquefaction separator 32 through line 34 are passed through similar pressure letdown values and then heated in exchangers 54 and 55 to a temperature approaching that of the liquid in line 22. These hot liquid streams are then combined and fed through line 56 to atmospheric fractionation unit 57.

In the atmospheric fractionation unit, the feed is fractionated and an overhead fraction composed primarily of gases and naphtha constituents boiling up to about 400° F. is withdrawn overhead through line 58. This overhead fraction is cooled in exchanger 59 and passed via line 60 to distillate drum 61 where the gases are taken overhead through line 62. The liquids product from drum 61 is withdrawn through line 63 and may be recycled in part through line 64 to the upper part of the fractionating column as reflux. The remaining naphtha may be passed through line 65 to line 50 for use in the naphtha scrubbing unit. Alternatively, the naphtha can be passed through line 66 for use as feed to the solvent hydrogenation unit as described hereafter or recovered as product. One or more intermediate fractions boiling within the range between about 250° F. and about 700° F. is withdrawn from atmospheric fractionator 57 for use as feed to the solvent hydrogenation reactor employed in the process. It is generally preferred to recover a relatively light fraction composed primarily of constituents boiling below about 700° F. by means of line 71, stripper 72, reflux line 73 and line 74. These two distillate fractions, plus a lower boiling overhead fraction is naphtha is not used to scrub the gases and vapors in scrubber 49, are passed through line 75 for use as liquid feed to the solvent hydrogenation unit. The bottoms fraction from the atmospheric column, composed primarily of constituents boiling in excess of about 700° F., is withdrawn through line 76, heated to a temperature of about 600° to 700° F. or the like in furnace 77 and introduced into vacuum fractionation unit 78 through line 79.

In the vacuum fractionating column, the feed is distilled under reduced pressure to permit the recovery of an overhead fraction which is withdrawn through line 80, cooled in exchanger 81 and then passed through line 82 into distillate drum 83. Gases and vapors are taken off through line 84 and liquids are withdrawn through line 85. The gas stream, and the gas stream from the atmospheric fractionator, can be employed as a fuel for generating process heat or used for other purposes. A heavier intermediate fraction, one composed primarily of constituents boiling below about 850° F. for example, may be recovered by means of line 86, heat exchanger 87, reflux line 88 and line 89. Still another, heavier sidestream may be withdrawn through line 90. These fractions are passed through line 91 and blended with the distillate fraction from the atmospheric column for use as feed to the solvent hydrogenation unit. A bottoms fraction boiling in excess of about 1000° F. and containing unreacted coal residues is withdrawn from the vacuum fractionation column through line 92 for use as feed to the coking or pyrolysis unit as described hereafter.

A number of alternates to the fractionation step described above may be employed for purposes of the invention if desired. One such alternate, for example, is to pass the liquid stream from the reactor effluent separator and the liquefaction separators to a centrifuge, gravity settling unit, filter or the like for the removal of unreacted coal solids from the liquids prior to fractionation. Antisolvents such as hexane, decalin, or certain petroleum hydrocarbon liquids can be added to the liquefaction products to facilitate separation of the unreacted coal and ash from the liquids and permit their removal from the system. Processes of this type have been described in the literature and will be familiar to those skilled in the art. The liquids remaining following this solids separation step can then be separated by fractionation into a naphtha fraction which may be used in scrubber 49, fed to the solvent hydrogenation unit or recovered as product naphtha, one or more intermediate streams to be fed to the solvent hydrogenation reactor, and a heavy bottoms fraction which can be employed as feed to the coking unit in accordance with the invention.

Another alternate procedure which is advantageous in some cases is to pass the liquid stream from the reactor effluent separator 20 and liquefaction separators 25 and 32, along with fresh feed coal, to the coking unit for upgrading of the liquids by the thermal cracking and other reactions. The coking unit in this case will normally include a coker fractionation tower in which the vaporized products from the coker are distilled to produce an overhead gas stream, a naphtha stream which can be employed as the naphtha supplied to scrubber 49 if desired, various streams useful as feed to the solvent hydrogenation reactor and product oil, and a heavier bottoms product which can be recycled, with fresh feed coal, to the coking unit. The coke produced in the coking unit can then be employed as feed to the gasifier for the production of hydrogen and other gaseous products. Still other modifications in the handling of the liquid products from the liquefaction reaction which may be employed for purposes of the invention will suggest themselves to those skilled in the art.

As indicated above, the liquid feed to the solvent hydrogenation reactor will normally include liquid hydrocarbons composed primarily of constituents in the 250° to 700° F. boiling range recovered from atmospheric fractionation unit 57 and a heavier stream in the 700° to 1000° F. range recovered from vacuum fractionation unit 78. It may also include liquid hydrocarbons of similar boiling range characteristics derived from the coking unit associated with the process. The liquid hydrocarbons from the atmospheric and vacuum fractionation units are combined in line 93, passed through heat exchanger 95 and introduced into solvent hydrogenation unit preheat furnace 96. Gas or a mixture of gas and vapor from compressor 47 is passed through line 97 and mixed with the liquid feed before it is introduced into the furnace. Makeup hydrogen supplied through line 98 and compressor 99 may be included if desired. In the furnace, the combined feed is heated to the solvent hydrogenation temperature and then passed to the hydrogenation reactor through line 100.

The solvent hydrogenation reactor shown in the drawing is a two-stage downflow unit including an initial stage 103 connected by line 104 to a second stage 105 but other types of reactors can be employed if desired. The hydrogenation reactor is preferably operated at a pressure somewhat higher than that in the liquefaction reactor and at a somewhat lower temperature than that in the liquefaction reactor. The temperature, pressure and space velocity employed in the reactor will depend to some extent on the character of the feed stream employed, the solvent used, and the hydrogenation conditions selected for the process. In general, however, temperatures within the range between about 550° F. and about 850° F., pressures between about 800 psig and about 3000 psig, and space velocities within the range between about 0.3 and about 3 pounds of feed/hour/pound of catalyst are preferred. Hydrogen treat rates within the range between about 1000 and about 12,000 standard cubic feet per barrel may be used. It is generally advantageous to maintain a mean hydrogenation temperature within the reactor between about 675° F. and about 750° F., a pressure between about 2000 and about 2500 psig, a liquid hourly space velocity between about 1 and about 2.5 pounds of feed/hour/pound of catalyst, and a hydrogen treat rate within the range between about 2000 and about 6000 standard cubic feet per barrel.

Any of a variety of conventional hydrotreating catalysts may be employed for purposes of the invention. Such catalysts typically comprise an alumina or silica alumina support carrying one or more iron group metals and one or more metals from Group VI-B of the Periodic Table in the form of an oxide or sulfide. Combinations of one or more Group VI-B metal oxide or sulfide are generally preferred. Representative metal combinations which may be employed in such catalysts include oxides and sulfides of cobalt-molybdenum, nickel-molybdenum-tungsten, cobalt-nickel-molybdenum, nickel-molybdenum, and the like. A suitable catalyst, for example, is a high metal content sulfided cobalt-molybdenum-alumina catalyst containing from about 1 to 10 weight percent of cobalt oxide and about 5 to 40 weight percent of molybdenum oxide, preferably from 2 to 5 weight percent of the cobalt oxide and from about 10 to 30 weight percent of the molybdenum oxide. Other metal oxides and sulfides in addition to those specifically referred to above, particularly the oxides of iron, nickel, chromium, tungsten and the like, can also be used. The preparation of such catalysts has been described in the literature and is well known in the art. Generally, the active metals are added to the relatively inert carrier by impregnation from aqueous solution and this is followed by drying and calcining to activate the catalyst. Carriers which may be employed include activated alumina, activated alumina-silica, zirconia, titania, bauxite, bentonite, montmorillonite, and mixtures of these and other materials. Numerous commercial hydrogenation catalysts are available from various catalyst manufacturers and can be used.

The hydrogenation reaction which takes place in reactor stages 103 and 105 is an exothermic reaction in which substantial quantities of heat are liberated. The temperature within the reactor is controlled to avoid over heating and runaway reaction or undue shortening of the catalyst life by controlling the feed temperature and by means of either a liquid or gaseous quench stream introduced between the two stages. The quantity of quench fluid injected into the system will depend in part upon the maximum temperature to which the catalyst is to be subjected, characteristics of the feed to the reactor, the type of quench used, and other factors. In general, it is preferred to monitor the reaction temperatures at various levels within each stage by means of thermocouples or the like and to regulate the amount of feed and quench admitted so that the temperature does not exceed a predetermined maximum for the level. By increasing the amount of feed through line 100 or the amount of quench added between stages whenever the temperature at the corresponding point in the reactor becomes too high, the overall reaction temperature can be maintained within predetermined bounds. If the hydrogenation reaction is to be carried out in the lower part of the 550° F. to 800° F. range, as may be the case when coal liquids of relatively low specific gravity and low sulfur and nitrogen content are being hydrogenated, a somewhat greater increase in temperature may be permissible than is the case where the hydrogenation reaction is to be carried out in the upper part of the 550° to 800° F. range. Operations of the latter type are frequently used for the hydrogenation of liquid products having high sulfur and nitrogen contents and relatively high specific gravities. The optimum temperature and other conditions for a particular feedstock and catalyst system can be readily determined.

The hydrogenated effluent from the second stage 105 of the reactor is withdrawn through line 106, passed in indirect heat exchange with the feed stream to the furnace in exchanger 95, and introduced through line 107 into high pressure liquid-gas separator 108 from which an overhead stream containing hydrogen gas is withdrawn through line 109. This gas stream is at least partially recycled through line 110 for reinjection with the feed slurry into liquefaction reactor preheat furnace 16.

If a gas quench is to be used in the solvent hydrogenation reactor, a portion of the gas stream from line 109 is withdrawn through line 112, cooled in heat exchanger 113 to a temperature sufficiently low to condense steam present in the gas, and then passed through line 114 to separator 115, from which the condensate is withdrawn as sour water through line 116. The overhead fraction from the separator is passed through line 117 to water scrubber 118 where it is countercurrently contacted with water introduced through line 119 for the removal of ammonia, hydrogen chloride, and other water-soluble constituents. The scrubbed gas then passes through line 120 into solvent scrubber 121 and is contacted with diethanolamine or similar solvent admitted through line 122 for the removal of hydrogen sulfide, carbon dioxide and the like. The gas from which ammonia and acid gases have been removed is passed through line 123 and compressor 124, and then introduced as quench through line 125 into line 104 between the two hydrogenation stages. The water and spent solvent from scrubbers 118 and 121 are withdrawn through lines 126 and 127 and passed to treating and regeneration facilities not shown in the drawing.

Liquid hydrocarbons are withdrawn from solvent hydrogenation separator 108 through line 128 and combined with liquids withdrawn from separator 115, if any, through line 129. The liquid stream is then passed through line 130 to final fractionator preheat furnace 131. As indicated above, the further hydrogenation step may be carried out with either a gaseous or a liquid quench. If a liquid quench is employed in lieu of a gaseous quench as described above, separator 115 and the associated scrubbers are not normally used and hence the only liquid sent to the fractionator preheat furnace will be that withdrawn from the separator 108.

In the final fractionator 132, preheated feed introduced from the furnace through line 133 is fractionated to produce an overhead stream composed primarily of gases and naphtha boiling range hydrocarbons. This stream is taken overhead through line 134, cooled in exchanger 135, and introduced into distillate drum 136. The off gases from the drum withdrawn through line 137 will be composed primarily of hydrogen and normally gaseous hydrocarbons but will also include some liquid constituents in the naphtha boiling range. This stream can be used as a fuel or employed for other purposes. The liquid stream which is withdrawn from the drum is composed primarily of naphtha boiling range material and will generally be recycled in part as reflux through line 139 and recovered in part as product naphtha through line 140. A stream of sour water will also normally be recovered from drum 136 through a water line not shown in the drawing.

One or more side streams boiling above the naphtha boiling range are recovered from fractionator 132. In the particular installation shown in the drawing, a first side stream composed primarily of hydrocarbons boiling up to about 700° F. is taken off through line 141 into stripper 142, the overhead fraction is returned as reflux through line 143, and the bottoms fraction is withdrawn through line 144 or recycled through the process through line 145. A second side stream composed primarily of hydrocarbons boiling below about 850° F. is withdrawn from the fractionator through line 146 into stripper 147, a portion is returned as reflux through line 148, and the bottoms fraction is withdrawn through line 149 or recycled through line 150. A bottoms fraction composed primarily of hydrocarbons boiling below about 1000° F. is withdrawn from the fractionator through line 151 and withdrawn as product through line 152 or recycled with the product from lines 145 and 150 through line 153.

If a liquid quench is used in the solvent hydrogenation step, a portion of the recycle stream is passed through line 154, heat exchanger 155 and line 156 into line 104 between the two solvent hydrogenation stages. The remaining recycle liquid, or all of it if a gas quench is employed in the hydrogenation step, is passed by means of line 157 and line 11 to the feed preparation step of the process for use as makeup solvent. The relative amounts of liquid recycled as solvent and recovered will depend upon the characteristics of the feed coal employed, the operating conditions selected, and other factors but in most cases substantial quantities of liquid product in addition to that produced in the coking unit are recovered.

The heavy bottoms product withdrawn from vacuum fractionation column 78 through line 92 is passed to coker feed preparation zone 160. This bottoms product, composed primarily of heavy highly aromatic hydrocarbon boiling above about 1000° F., unconverted char particles from the liquefaction step, and ash particles, may constitute as much as 50 weight percent of the total product from the liquefaction step of the process. It is normally a solid at room temperature and is therefore handled at elevated temperature in order to maintain it in the liquid state. In some cases, however, it may be advantageous to solidify the bottoms product and later reheat the material before it is subsequently processed in accordance with the invention. In the coker feed preparation zone, the liquefaction bottoms may be blended with char fines produced in the gasification stage of the process and introduced into the feed preparation zone through line 161. If desired, a heavy oil produced as liquefaction effluent separator bottoms or final fractionator bottoms in the liquefaction step of the process may be blended with the vacuum fractionator bottoms to facilitate their handling. This blending step may be carried out within the coker feed preparation zone 160 or may instead be done prior to introduction of the liquids into the feed preparation zone. The liquids and char fines are normally blended in a weight ratio of from about 0.1 to about 3 parts of bottoms per part of fines but ratios outside this range may in some cases be employed if desired. The optimum ratio for a particular system will depend in part upon the physical characteristics of the bottoms fraction and fine particles, the amount and type of coal feed employed at this point in the process, the blending temperature, the coking conditions to be employed, and other factors. In general, the use of from about 0.3 to about 1 part of bottoms per part of char fines is preferred.

Feed coal is introduced into the coker feed preparation zone 160 through line 162. This feed coal may be a bituminous coal, subbituminous coal, lignite, or similar carbonaceous solid containing volatilizable hydrocarbons and may be the same or different from the feed coal employed in the liquefaction step of the process. The feed coal particles will preferably be crushed and screened to a particle size of about 8 mesh or smaller on the U.S. Sieve Series Scale and will normally be dried to remove excess water. In most cases the coal employed in the liquefaction step and that used in the coking step will be obtained from the same source and hence the coal feed for both steps can generally be prepared in a single coal preparation zone not shown in the drawing. The fresh feed coal thus introduced is mixed in coker feed preparation zone 160 with liquefaction bottoms or a mixture of liquefaction bottoms and gasifier fines in a ratio of from about 0.1 to about 10 parts of coal per part of liquefaction bottoms or bottoms and fines. The optimum ratio for a particular operation will depend in part upon the particular coal employed, the characteristics of the liquefaction bottoms used, the amount of gasifier fines present if any, the coking conditions to be used, and other factors. In general, it is normally preferred to use from about 0.3 to about 3 parts by weight of fresh feed coal for each part of liquefaction bottoms or mixed liquefaction bottoms containing gasifier fines employed. The optimum ratio for any particular operation can be readily determined but will generally be about one to one.

The hot slurry of coal and liquefaction bottoms prepared in coker feed preparation zone 160 is withdrawn from the preparation zone through line 163, may be mixed with a high temperature coker bottoms stream introduced through line 164, and is passed through injection lines 165, 166 and 167 into the reaction section of a fluidized bed coking unit 168. If desired, the high temperature bottoms stream can be injected directly into the feed preparation zone 160 through line 169 or may instead be eliminated. The coking unit includes a lower reaction section containing a fluidizied bed of coked particles maintained in the fluidized state by means of steam introduced into the lower portion of the unit through line 170 and an upper scrubbing and fractionation section from which liquid and gaseous products produced as a result of the coking reaction are withdrawn. The unit will also normally include one or more internal cyclone separators or similar devices not shown in the drawing which serve to remove entrained particles from the upflowing gases and vapors and return them to the fluidized bed below. The bed temperature in the unit is generally maintained between about 900° F. and about 1400° F. by means of hot char which is introduced into the upper part of the reaction sections of the unit through riser 171. The pressure within the reaction section will normally range between about 10 and about 30 pounds per square inch gauge but higher pressures can be employed if desired. The optimum conditions for use in the coking zone will depend in part upon the characteristics of the feed material employed and may be varied as necessary.

The slurry of liquefaction bottoms and coal particles introduced into the reaction section of the coking unit, with or without char fines, is sprayed onto the surfaces of the coke particles in the fluidized bed and rapidly heated to bed temperatures. As the temperature increases, liquid constituents of the slurry are vaporized and the heavier portions undergo thermal cracking and other reactions to form lighter products and additional coke. Simultaneously, volatilizable hydrocarbons present in the feed coal are vaporized are liberated. Other reactions also take place. The liberated volatile materials limit the amount of additional coke formed and at the same time the bottoms reduce the conversion of liquid products into gases. The vaporized products, unreacted steam and entrained solids move upwardly through the fluidized bed, pass through the cyclone separators or other devices where coke particles present in the fluid stream are rejected, and move into the scrubbing and fractionation section of the unit. The coke particles and any unreacted solids move downwardly in the fluidized bed and are eventually withdrawn from the bottom of reactor 168 through line 172. During the process, the average size of the coke particles increases as the particles move through the fluidized bed due to the formation of additional coke from the slurry liquids and solids.

In the fractionation section of the coking unit, the fluid stream passing overhead from the reaction section is cooled to condense out a heavy bottoms fraction boiling in excess of about 1000° F. and scrubbed to remove the remaining solids. The heavy bottoms product containing the solids thus removed is recycled through line 164 for reintroduction into the reactor with the slurry of heavy oil and char fines. As pointed out earlier, this heavy stream may instead be passed to the coker feed preparation zone if desired. This latter procedure has certain advantages in that it supplies additional heat to the feed preparation zone and may facilitate handling of the heavy liquefaction bottoms employed in the feed stream. In the upper part of the fractionation section, the lighter constituents of the reaction product stream are fractionated. Gases and naphtha boiling range constituents are taken overhead through line 173, passed through heat exchanger 174, and introduced into drum 175. Here the gaseous constituents are separated and taken overhead through line 176. This stream will normally contain hydrogen, carbon monoxide, carbon dioxide, and light hydrocarbons and may be employed as a fuel, used as a source of hydrogen for the liquefaction step of the process, or utilized for other purposes. The liquids separated in drum 175, composed primarily of naphtha boiling range hydrocarbons, are withdrawn through line 177. A portion of this stream is recycled to the fractionation section of the coking unit through line 178 and the rest is withdrawn through line 179 as product naphtha. A sour water stream is withdrawn through line 180. One or more intermediate side streams are also recovered from the fractionation section of the unit. In the particular unit shown, a single stream is withdrawn through line 181 into stripper 182, the overhead is returned as reflux through line 183, and a liquid hydrocarbon stream boiling in the gas oil range is recovered through line 184. Although a single intermediate side stream is shown, two or more such streams may be recovered. These streams constitute additional liquid products from the integrated process and may be employed for a variety of different purposes.

The coke withdrawn from the bottom of the reaction section of the coking unit through line 172 will normally pass through a slide valve or similar device not shown in the drawing which serves to control the height of the bed within the unit, generally between about 30 and about 50 feet. The bed velocity generally ranges from about 1 to about 3 feet per second and the reactor holding time is normally between about 10 and about 30 seconds. The downflowing coke particles in line 172 are entrained in a stream or other carrier gas and carried upwardly through riser 185 into fluidized bed burner 186. Air or other oxygen-containing gas is introduced into the bottom of the burner through line 187 to aid in maintaining the coke particles in the fluidized state and provide the oxygen required for combustion of a portion of the coke. The burner temperature will generally be maintained within the range between about 1100° F. and about 1500° F. by regulating the amount of air admitted. The bed temperature should usually be from about 50° to about 300° F. in excess of that within the reaction section of the coking unit 168. The pressure within the burner will generally be similar to that in the reactor, between about 10 and about 30 pounds per square inch gauge. Hot coke particles are withdrawn from the burner through standpipe 188 and recycled by means of a stream of steam or other carrier gasto the reaction section through line 171. Hot combustion gases are taken overhead from the burner through line 189, subjected to conventional treatment for the recovery of heat and the removal of contaminants, and then may be discharged into the atmosphere. The burner will normally include one or more internal cyclone separators not shown in the drawing for the removal of coke particles from the upflowing gases before they leave the burner. The bed velocity within the burner will normally range between about 2 and about 3 feet per second and the depth of the bed is generally controlled at between about 10 and about 15 feet.

Hot char particles are continuously withdrawn from burner 186 through line 190 containing a slide valve or other control means not shown in the drawing and pass into fluidized bed vessel 191. The withdrawn particles are maintained in the fluidized state by means of steam or other fluidizing gas injected into the bottom of the vessel through line 192. An overhead stream of gas containing entrained coke particles is taken off through line 193 and returned to the fluidized bed within the burner. A stream of larger coke particles is withdrawn from vessel 191 through line 194 and entrained in a stream of steam or other carrier gas admitted into the system through line 195. The resulting stream of fluidized solids is then passed upwardly through riser 196 into fluidized bed gasifier 197. Solid particles of potassium carbonate, potassium acetate, potassium formate, cesium carbonate, or a similar organic or inorganic alkali metal or alkaline earth metal compound introduced through line 198 or feed coal particles impregnated with such a compound and added through line 199 may be added to the coke particles in line 196 by means of hopper 200 and line 201 to catalyze the gasification reaction. Studies have shown that the use of such an alkaline gasification catalyst accelerates the gasification reaction, lowers the temperature required for gasifications purposes, and has other significant advantages. In lieu of a single gasifier injection line as shown, a plurality of injection nozzles may be employed to feed the coke particles into the gasifier.

Within the gasification zone, the injected coke particles react with steam introduced into the lower portion of the gasifier through line 202 and multiple injection nozzles 203. The steam maintains the carbonaceous solids within the gasifier in a fluidized bed and reacts with carbon in the solids to produce hydrogen, carbon monoxide, carbon dioxide, methane and some higher hydrocarbons. Depending upon the gasification products desired and whether an alkali metal catalyst is employed, the temperature within the gasifier may range from about 1000° F. to about 2000° F. or higher and the gasification pressure may be maintained between about 50 psig and about 2000 psig. Where it is desired to produce substantial quantities of methane and other hydrocarbons, gasification temperatures between about 1000° and about 1600° F. and pressures between about 500 and about 1500 psig are generally preferred. Where the principal product of the gasification reaction is to be a synthesis gas containing hydrogen and carbon monoxide, on the other hand, higher temperatures and lower pressures may be used. In either case, the use of an alkali metal catalyst in the gasification reaction may be beneficial.

As indicated above, the gasification step of the process of the invention can be carried out with both coke from the coking step and feed coal introduced into the gasifier in combination with the coke particles if desired. Coal particles crushed and screened to a size of about 8 mesh or smaller on the U.S. Sieve Series scale will preferably be used. In the upper part of the fluidized bed, devolatilization of the coal takes place and hydrogasification reactions in which hydrogen generated in the lower portion of the bed reacts with carbon to produce methane also occurs. This use of coal feed in the gasification step may result in higher methane contents than can generally be obtained by the gasification of coke alone and is therefore often advantageous. An alkali metal catalyst such as potassium carbonate will preferably be employed in the form of an aqueous solution with which the coal is impregnated prior to its introduction into the gasifier. As pointed out above, the use of such a catalyst significantly improves the gasification rate and permits the use of lower gasification temperatures.

The gasification unit depicted in the drawing is one in which a transfer line burner 206 is used to supply a portion of the heat needed for the gasification reaction. In this system, hot coke or char particles are continuously withdrawn from the lower portion of the fluidized bed in gasifier 197 through line 207 and introduced to a stream of steam or other carrier gas which carries the carbonaceous particles upwardly through line 208 into the lower end of the burner. An oxygen-containing gas is introduced near the bottom of the burner through line 209 to aid in fluidizing the particles and initiate combustion. It is normally preferred to dilute the gas fed at the bottom of the burner with an inert gas introduced through line 210 so that the oxygen content of the gas injected at this point is less than about 15% by volume. Additional oxygen-containing gas, preferably air, is introduced into the burner at one or more levels along its length through line 211 to supply the additional oxygen required to support the combustion reaction. It is preferred that combustion within the burner is controlled so that the carbonaceous particles leaving the upper end of the unit have a temperature of from about 50° to about 300° F. higher than the temperature within the fluidized bed gasifier.

The hot particles leaving the upper part of the burner pass into cyclone separator 212 where the gases and entrained fines are separated from the larger coke or char particles. The solids removed from the gas stream pass downwardly through standpipe 213 and are returned to the gasifier by entraining them in a stream of carrier gas, steam preferably, introduced into the lower end of the gasifier through line 214. The gases taken overhead from separator 212 are passed through line 215 to cyclone separator or the like 216 where entrained solids too small to be removed in separator 212 are taken out of the gas stream. These solids, withdrawn through line 217, will consist primarily of ash and may be used for land fill purposes, employed for construction purposes, or utilized in other applications. The gases taken overhead through line 218 are sent to downstream heat recovery and treating units for the elimination of contaminants prior to their discharge into the atmosphere.

In lieu of using a transfer line burner as described above, the heat needed for the gasification reaction can be supplied by feeding hot solids from burner 186 directly to the gasifier or using a separate fluidized bed heater or other combustion vessel in which carbonaceous solids are burned and hot solids or combustion products are returned to the gasifier. In some cases, heat can also be generated by the introduction of air or oxygen into the gasifier to burn a portion of the carbonaceous material present in the fluidized bed. This procedure normally requires investment in an oxygen plant or results in the introduction of substantial quantities of nitrogen into the product gas stream and therefore has drawbacks.

The raw product gas generated by gasification of the coke or mixture of coal and coke in the fluidized bed of gasifier 197 is taken overhead from the gasifier through line 219 and passed to cyclone separator or similar separation device 220. Fines contained in the gas, normally less than 325 mesh on the U.S. Sieve Series scale in size, are removed from the gas stream and withdrawn from the separator through 221. Although a single separator is shown in the drawing, it will normally be advantageous to provide two or more separators in which fines of successively smaller sizes are removed from the gas stream. The fines thus recovered may be passed from line 221 through line 161 to coker feed preparation zone 160 for mixture with bottoms from the liquefaction step of the process. The gas from which the fines have been removed is recovered from the separator through line 222. This gas stream will generally contain hydrogen, carbon monoxide, carbon dioxide, methane, and small amounts of other normally gaseous hydrocarbons. It may also include hydrogen sulfide, carbonyl sulfide, phenols, benzene and the like, particularly if coal is fed to the gasifier. The gas is passed through one or more heat exchangers 223 for the recovery heat and then introduced into scrubber 224 where it is contacted with water introduced through line 225 for the removal of water soluble constituents in the gas. The water withdrawn through line 226 is passed to suitable water-treating facilities not shown in the drawing. The gas is withdrawn from the scrubber through line 227 and all or part of the gas may be passed through line 228 for the removal of contaminants and upgrading of the gas for use as a fuel or synthesis gas stream.

It is generally preferred to pass at least part of the raw product gas stream through line 229 and heat exchangers 230 and 231 into a catalytic water-gas shift unit where it is reacted with steam introduced through line 232 to convert carbon monoxide to carbon dioxide and generate additional hydrogen. The shift unit shown in the drawing is a staged unit including a first stage 233 and a second stage 234 with cooling between the stages to control the reaction temperature. Any of a variety of water-gas shift catalysts may be employed in the shift reactor but it is normally preferred to utilize an alkali metal catalyst containing cesium carbonate or a similar alkali metal compound or a mixture of such compounds. Such shift catalysts are generally effective at relatively low temperatures, are relatively insensitive to sulfur compounds in the gas, and have other advantages over other catalysts which have been used to promote the shift reaction.

The shifted gas, composed primarily of hydrogen and carbon dioxide, is passed through line 235 to solvent scrubber 236 where it is contacted with diethanolamine or a similar solvent for removal of the carbon dioxide and any other acid gases which may be present. The spent solvent is withdrawn through line 238 for recovery and regeneration of the solvent and the scrubbed gas is taken overhead through line 239. This gas stream will normally be raised to liquefaction pressure in compressor 240 and then recycled to the liquefaction process. A portion of the recycled gas may be passed through line 241 and 15 for introduction into the solvent-coal slurry fed through the liquefaction preheat furnace 16 into liquefaction reactor 18. Additional gas may be introduced through line 98 to compressor 99 for introduction into the feed stream to the solvent hydrogenation reactors. This use of the recycle gas eliminates the necessity for supplying makeup hydrogen to the liquefaction process from extraneous sources and has numerous other advantages.

As indicated above, at least part of the gas produced in the gasification step of the process may be further processed to upgrade its methane content and permit its use as a high or intermediate Btu synthetic fuel. It can also be employed for the synthesis of hydrocarbons by the Fischer-Tropsch processes or employed as a low Btu fuel without upgrading. In still other cases, methane can be recovered from the raw product gas and at least part of the remaining hydrogen and carbon monoxide can be recycled to the gasifier to suppress gas phase reactions taking place in the presence of the gasification catalyst which tend to produce additional hydrogen and carbon monoxide and thus promote the generation of more methane. Still other modifications of the process as shown in the drawing, including the use of a delayed coker or Flexicoker in place of the fluid coker shown and the use of other types of gasifiers in lieu of the particular fluidized bed unit depicted, will suggest themselves to those skilled in the art.

The advantages of the process of the invention are further illustrated by the results of a series of tests in which a heavy 1000° F.$^+$ bottoms fraction produced by the liquefaction of Illinois No. 6 coal at nominal conditions of 840° F. and 1500 psig in a process similar to that depicted in the drawing, a sample of the Illinois No. 6 coal itself, and a mixture of equal parts of the liquefaction bottoms and the Illinois No. 6 coal were pyrolyzed at 1200° F. and atmospheric pressure in a bench scale pyrolysis unit and the amounts of gas, liquid and coke produced during the pyrolysis operations were determined. Yields for the mixture were also calculated for the mixture assuming that the yields from the components were additive. These yields are set forth in Table I and illustrated in FIG. 2 of the drawing.

TABLE I

| Pyrolysis of Coal/Liquefaction Bottoms Mixtures | | | | | | | | | |
|---|---|---|---|---|---|---|---|---|---|
| | Pyrolysis Yields at 1200° F. - Wt. % | | | | | | | | |
| Weight Ratio | Coke | | | Liquid | | | Gas | | |
| Coal/Bottoms | Exp. | Calc. | Δ | Exp. | Calc. | Δ | Exp. | Calc. | Δ |
| 0/100 | 65.5 | | — | 28.3 | | | 6.2 | | — |
| | | Avg. | | | Avg. | | | Avg. | |
| 0/100 | 65.8 | 65.6 | — | 28.6 | 28.5 | | 5.6 | 5.9 | — |
| 11.1/88.9 | 64.6 | 65.2 | − .6 | 29.1 | 27.9 | +1.2 | 6.3 | 6.9 | − .6 |
| 28.5/71.5 | 64.1 | 64.6 | − .5 | 29.0 | 27.0 | +2.0 | 6.9 | 8.4 | −1.5 |
| 45.7/54.3 | 62.8 | 64.0 | −1.2 | 29.6 | 26.2 | +3.4 | 7.6 | 9.9 | −2.3 |
| 50.0/50.0 | 61.5 | 63.8 | −2.3 | 30.3 | 26.0 | +4.3 | 8.3 | 10.3 | −2.0 |
| 68.5/31.5 | 62.2 | 63.1 | − .9 | 27.6 | 25.0 | +2.6 | 10.2 | 11.9 | −1.7 |
| 87.4/12.6 | 62.1 | 62.5 | − .4 | 25.6 | 24.0 | −1.6 | 12.3 | 13.5 | −1.2 |
| 100/0 | 61.9 | | — | 22.9 | | | 15.3 | | |
| | | Avg. | | | Avg. | | | Avg. | |
| 100/0 | 62.1 | 62.0 | — | 23.9 | 23.4 | | 14.0 | 14.6 | |

Figure 2:
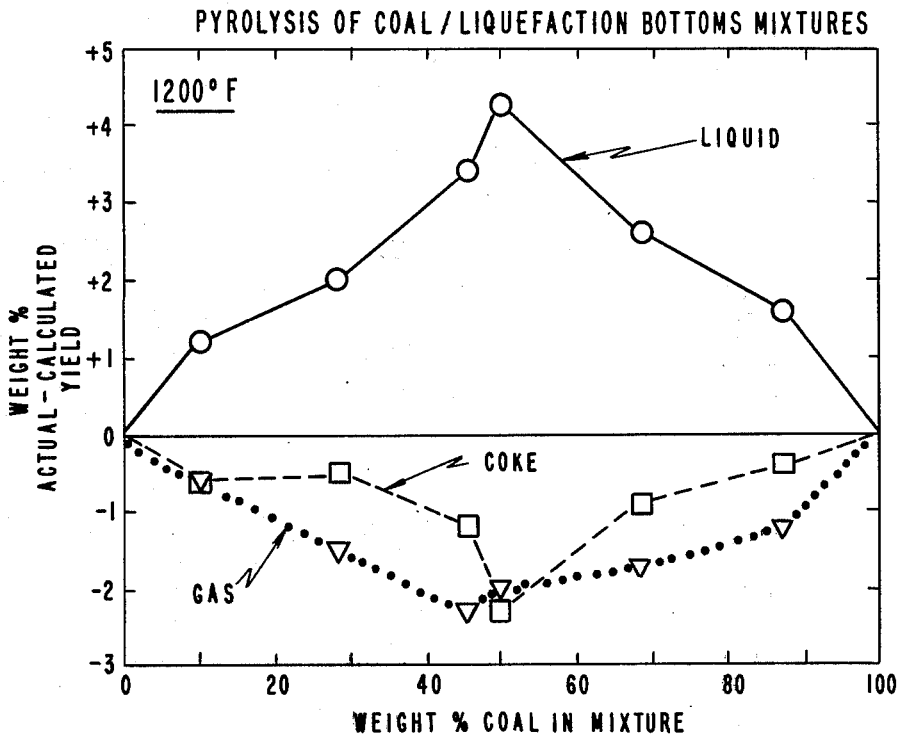
FIG. 2 is a plot showing the results of experimental pyrolysis runs carried out in accordance with the invention.

It will be noted from the data in Table I and FIG. 2 that the liquid yields obtained with the mixture of liquefaction bottoms and coal were significantly higher than the additive values over the entire range of mixture proportions. As can be seen from FIG. 2, this unexpected increase in liquid yields is accompanied by a decrease in the amount of coke and gas produced. The reasons for this synergistic effect are not fully understood but it may be that molecular fragments formed during pyrolysis which would normally polymerize to produce coke are stabilized as liquids by fragments which would otherwise result in the production of gases. It can be seen that the synergism is particularly pronounced with bottoms to coal ratios between about 1:3 and about 3:1 and is a maximum when mixture containing about equal parts of the bottoms and coal are employed. This results in the production of about 4% extra liquid based on the total sample, a 15% increase in the liquid yield. Such an increase represents a significant advantage and could have a substantial effect on the economies of coal liquefaction operations.

Figure 3:
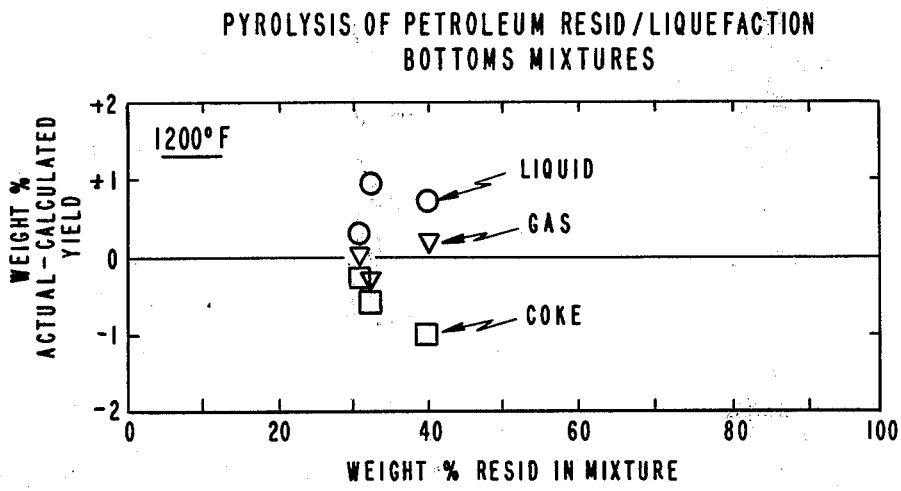
FIG. 3 is a plot similar to that of FIG. 2 showing the results obtained when a heavy residual petroleum fraction is used in lieu of the liquefaction bottoms.

Table II and FIG. 3 in the drawing illustrate the results obtained when a heavy petroleum vacuum residuum was mixed with liquefaction bottoms and pyrolyzed in the same manner as the mixture of liquefaction bottoms and coal referred to above. The residuum was a West Texas Sour Rock residuum having a nominal boiling point of about 1000° F. and a 29% Conradson carbon content. No coal was used. It will be noted from FIG. 3 that little if any synergism occurred.

TABLE II

| Pyrolysis of Petroleum Resid/Liquefaction Bottoms Mixtures | | | | | | | | | |
|---|---|---|---|---|---|---|---|---|---|
| | Pyrolysis Yields at 1200° F. - Wt. T | | | | | | | | |
| Weight Ratio | Coke | | | Liquid | | | Gas | | |
| Resid Bottoms | Exp. | Calc. | Δ | Exp. | Calc. | Δ | Exp. | Calc. | Δ |
| 0/100 | 65.5 | | | 28.3 | | | 6.2 | | |
| | | Avg. | | | Avg. | | | Avg. | |
| 0/100 | 65.8 | 65.6 | | 28.6 | 28.5 | | 5.6 | 5.9 | |
| 30.9/69.1 | 52.5 | 52.8 | − .3 | 37.8 | 37.5 | +.3 | 9.7 | 9.7 | 0 |
| 32.5/67.5 | 51.5 | 52.1 | − .6 | 38.9 | 38.0 | +.9 | 9.6 | 9.9 | −.3 |
| 39.9/60.1 | 48.1 | 49.1 | −1.0 | 40.9 | 40.2 | +.7 | 11.0 | 10.8 | +.2 |
| 100/0 | 23.5 | | | 57.8 | | | 18.7 | | |
| | | Avg. | | | Avg. | | | Avg. | |
| 100/0 | 25.0 | 24.2 | | 57.5 | 57.7 | | 17.5 | 18.1 | |

It will be apparent from the foregoing that the invention provides an improved process for the production of liquid hydrocarbons from coal which has numerous advantages over processes employed in the past.

I claim:

1. A process for the production of liquid hydrocarbons from carbonaceous solids containing volatilizable hydrocarbons which comprises contacting said carbonaceous solids with gaseous hydrogen and a hydrogen-donor solvent under coal liquefaction conditions in a liquefaction zone; recovering liquefaction products from said liquefaction zone; separating said liquefaction products into a gaseous stream, a liquid hydrocarbon stream, and a heavy liquefaction bottoms product; pyrolyzing said liquefaction bottoms product and fresh carbonaceous solids containing volatilizable hydrocarbons in a pyrolysis unti operated at a temperature in excess of about 900° F.; and recovering gases, liquid hydrocarbons, and coke from said pyrolysis unit.

2. A process as defined by claim 1 wherein said carbonaceous solids comprise a bituminous or lower rank coal.

3. A process as defined by claim 1 wherein said pyrolysis unit comprises a fluidized bed coking unit.

4. A process as defined by claim 1 wherein said liquefaction bottoms product and said carbonaceous solids are pyrolyzed in said pyrolysis unit in a ratio of from about 0.3 to about 3 parts by weight of carbonaceous solids per part of liquefaction bottoms.

5. A process as defined by claim 1 wherein said pyrolysis unit is operated at a temperature between about 900° and about 1400° F.

6. A process as defined by claim 1 wherein about equal parts by weight of said liquefaction bottoms product and said carbonaceous solids are pyrolized in said pyrolysis unit.

7. A process as defined in claim 1 wherein coke recovered from said pyrolysis unit is fed to a fluidized bed gasification unit operated under coal gasification conditions and a raw product gas is recovered from said gasification unit.

8. A process as defined by claim 7 wherein at least part of said raw product gas recovered from said gasification unit is treated to increase its hydrogen content and the treated gas is recycled to said liquefaction zone.

9. A process as defined by claim 7 wherein said coke recovered from said pyrolysis unit is mixed with fresh carbonaceous solids containing volatilizable hydrocarbons and fed to said gasification unit.

10. A process as defined by claim 7 wherein said coke recovered from said pyrolysis unit is fed to said gasification unit in combination with an alkaline gasification catalyst.

11. A process for the production of liquid hydrocarbons which comprises pyrolyzing a mixture of finely-divided coal and a heavy coal liquefaction bottoms product produced by the liquefaction of coal in the presence of gaseous hydrogen and a hydrogen-donor solvent and recovering gases, hydrocarbon liquids, and coke.

* * * * *